US007726668B2

(12) United States Patent
Sieb et al.

(10) Patent No.: US 7,726,668 B2
(45) Date of Patent: Jun. 1, 2010

(54) MECHANIC'S CREEPER

(76) Inventors: Kristopher Sieb, 701 avenue Marois, Quebec (CA) G1S 4H5; Erik Sieb, 701 avenue Marois, Quebec (CA) G1S 4H5

( * ) Notice: Subject to any disclaimer, the term of this patent is extended or adjusted under 35 U.S.C. 154(b) by 656 days.

(21) Appl. No.: 11/340,217

(22) Filed: Jan. 26, 2006

(65) Prior Publication Data

US 2006/0186619 A1 Aug. 24, 2006

Related U.S. Application Data

(60) Provisional application No. 60/647,025, filed on Jan. 27, 2005.

(51) Int. Cl.
*B25H 5/00* (2006.01)

(52) U.S. Cl. ..... 280/32.6; 280/640

(58) Field of Classification Search ..... 280/639, 280/638, 9, 20, 32.6, 47.25, 47.24, 32.5, 280/47.19, 47.35, 47.38, 640
See application file for complete search history.

(56) References Cited

U.S. PATENT DOCUMENTS 1,431,383 A * 10/1922 Edwards ..... 280/32.6
5,099,951 A 3/1992 Stockwell
7,114,742 B1 * 10/2006 Sterns ..... 280/639

* cited by examiner

*Primary Examiner*—Lesley Morris
*Assistant Examiner*—John R Olszewski
(74) *Attorney, Agent, or Firm*—Goudreau Gage Dubuc; Hugh Mansfield

(57) ABSTRACT

A creeper is disclosed for protecting a user in a supine position when manoeuvring under a raised object. The creeper comprises a user support surface and a safety structure. The safety structure comprises at least one upwardly projecting rigid element defining a protective space above at least a portion of the support surface. A foldable creeper which folds into a work bench and comprises a similar safety structure is also disclosed.

17 Claims, 11 Drawing Sheets

MECHANIC'S CREEPER

CROSS REFERENCE TO RELATED APPLICATIONS

This application claims priority on U.S. provisional application No. 60/647,025, filed on Jan. 27, 2005, herein incorporated by reference.

FIELD OF THE INVENTION

The present invention relates to creepers and, more specifically, to creepers for use in manoeuvring under an object such as a motor vehicle.

BACKGROUND OF THE INVENTION

Creepers for use in working or manoeuvring beneath automobiles, trucks and other such motor vehicles are well known and have been used by the novice and professional automobile mechanic for years. Such known creepers, as exemplarily illustrated by the creeper 2 in FIG. 1, are generally comprised of a framework 4 to which is mounted a substantially flat body support surface 6 upon which a user may rest his head and/or back, and a set of wheels or casters 8 allowing the creeper to be displaced below a vehicle (not shown).

However, it has been found that the common creeper design does not provide for a safe work environment. For instance, when using a creeper to work under a vehicle, which is generally raised on jacks or jack stands, a mechanic generally lays flat on the creeper to roll himself under the vehicle. Since common creepers do not provide any type of body or head protection for the mechanic working underneath the raised vehicle, the mechanic is generally vulnerable to severe injury in the event the vehicle should fall from its raised position.

SUMMARY OF THE INVENTION

In order to address the above and other drawbacks of known creepers, it is an aim of the present invention to provide a creeper adapted to provide protection to a user thereof from a falling object.

More specifically, in accordance with the present invention, there is provided a creeper for protecting a user in a supine position when manoeuvring under a raised object, the creeper comprising a support structure comprising a frame and a user support surface, and a safety structure coupled to the frame, the safety structure comprising at least one upwardly projecting rigid element defining a protective space above at least a portion of the support surface.

Still in accordance with the present invention, there is provided a creeper for protecting a user in a supine position when manoeuvring under a raised object, the creeper comprising a user support surface and a safety structure, the safety structure comprising at least one upwardly projecting head protective element disposed towards a first longitudinal end of the surface and at least one upwardly projecting body protective element disposed towards a second longitudinal end of the surface, the protective elements defining a protective space above at least a portion of the surface. The at least one head protective element and the at least one body protective element are longitudinally spaced apart and define a longitudinal space therebetween, thereby providing the user substantially unobstructed access to the object from the surface within the longitudinal space.

Still further in accordance with the present invention, there is provided a creeper for protecting a user in a supine position when manoeuvring under a raised object, the creeper comprising a user support surface, displacement means, load-absorbing means and a safety structure, the safety structure comprising at least one upwardly projecting rigid element defining a protective space above at least a portion of the surface. The displacement means are structurally coupled to the safety structure via the load-absorbing means such that, when the safety structure is subjected to the weight of the object, the load-absorbing means retracts the displacement means relative to the surface.

Other objects, advantages and features of the present invention will become more apparent upon reading of the following nonrestrictive description of specific embodiments thereof, given by way of example only with reference to the accompanying drawings.

BRIEF DESCRIPTION OF THE DRAWINGS

Reference will now be made to the accompanying drawings, showing by way of illustration, illustrative embodiments of the present invention, and in which.

DESCRIPTION OF THE ILLUSTRATIVE EMBODIMENTS

Figure 2:
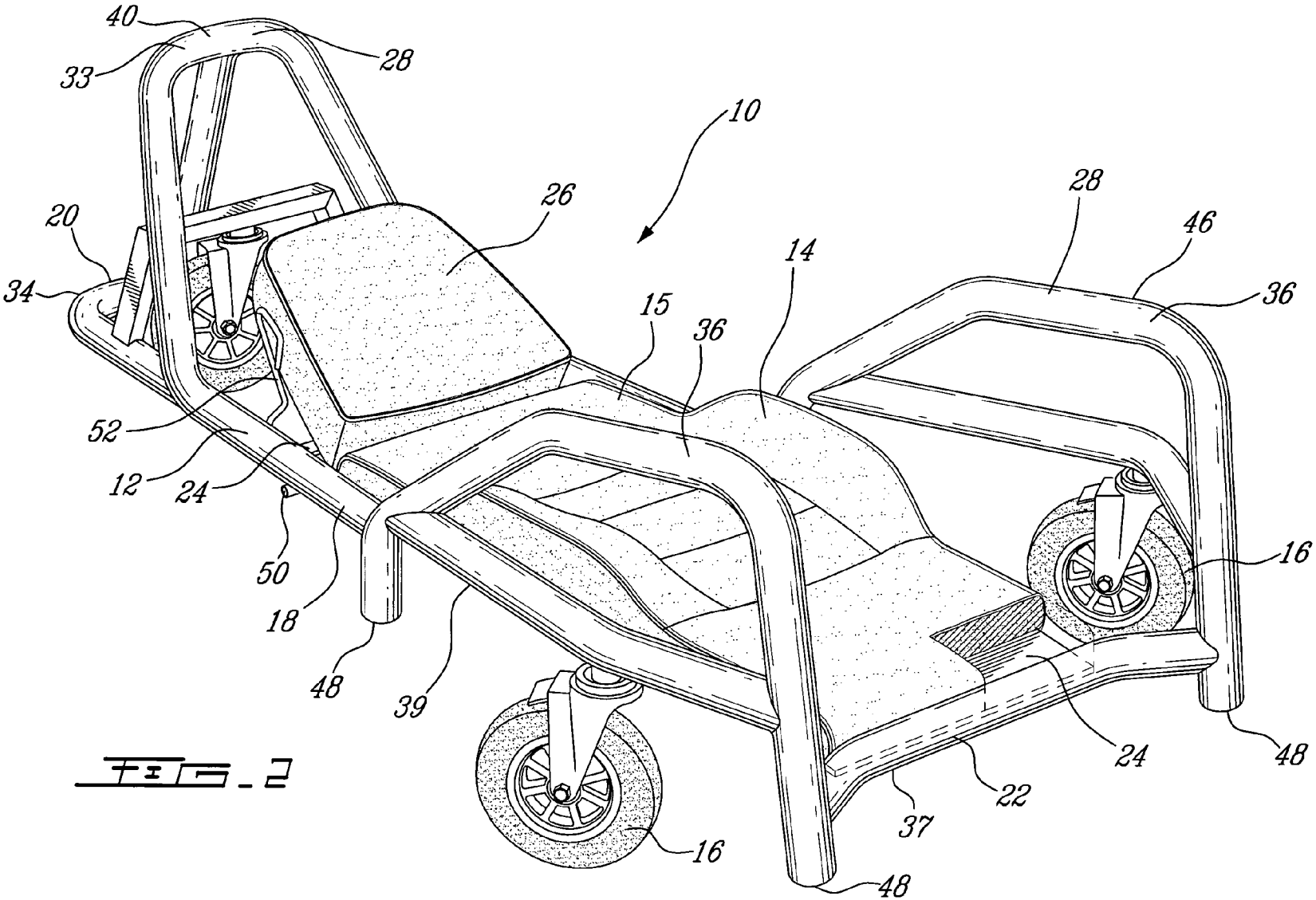
FIG. 2 is a side perspective view of a creeper in accordance with a first illustrative embodiment of the present invention.

Referring now to FIG. 2, a mechanic's creeper, generally referred to using the numeral 10, and in accordance with an illustrative embodiment of the present invention, will now be described. The creeper 10 is generally for use by a professional or novice mechanic, or any individual for that matter that seeks to obtain access, generally in a supine position, to the under body of a vehicle or other such heavy machinery (not shown) for maintenance, inspection, general reparation or any other such activity. The vehicle in question may be raised using a standard jack or jack stands, or any other such device that will allow the vehicle to be raised sufficiently to allow the individual to work in a supine position underneath it.

The creeper 10 generally comprises a frame or framework 12, a user support surface 14 coupled thereto and a set of casters, wheels or other such displacement means 16 rotatably and typically pivotally mounted thereunder. The framework 12 generally defines a longitudinal structure comprising a set of lateral bars 18, a head bar 20 at a first longitudinal end thereof and a foot bar 22 at an opposite longitudinal end thereof. A set of transversal support bars and/or plates 24, integrally coupled between the lateral bars 18, form a support structure for the support surface 14.

In general, the framework 12 can be manufactured of any standard solid material such as steel, aluminium, hard plastic or any other such material or combination thereof. The framework 12 may be manufactured, for example, as a single piece from a moulded material or the like, or again constructed of various pieces including solid bars, hollow square or circular pipes and tubing and other such products fastened or welded together by any solid fastening or coupling means. In the illustrated embodiment, the framework 12 is composed of rigid tubular bars integrally welded together to provide a solid finished product. A person of skill in the art will understand that other solid constructions may also be considered without departing from the general scope and nature of the present disclosure.

Still referring to FIG. 2, the user support surface 14 generally provides the surface upon which the user will lie face-up, generally in a supine position, to complete a desired task under the vehicle. The surface 14 can be modified to provide various degrees of comfort to the user's back and can optionally comprise an elevated or adjustable headrest, as in 26, for increased comfort. In the illustrative embodiment of FIG. 2, the surface 14 is comprised of a padded backboard 15, a substantially planar structure lined with fabric and an ergonomically moulded cushion and, an adjustable headrest 26. Alternatively, the framework 12 and support surface 14 could be manufactured together, possibly as a single solid piece.

The casters or wheels 16 are generally configured to provide adequate mobility to the user on the creeper 10. For instance, a set of three (3) swivelling casters 16 are illustratively disposed on the creeper 10, suitably mounted to framework 12 at the head and on each side thereof. Other basic constructions and configurations of the framework 12, user support surface 14 and casters 16 of creeper 10 will be apparent to a person of skill in the art and thus need not be described further herein.

Figure 1:
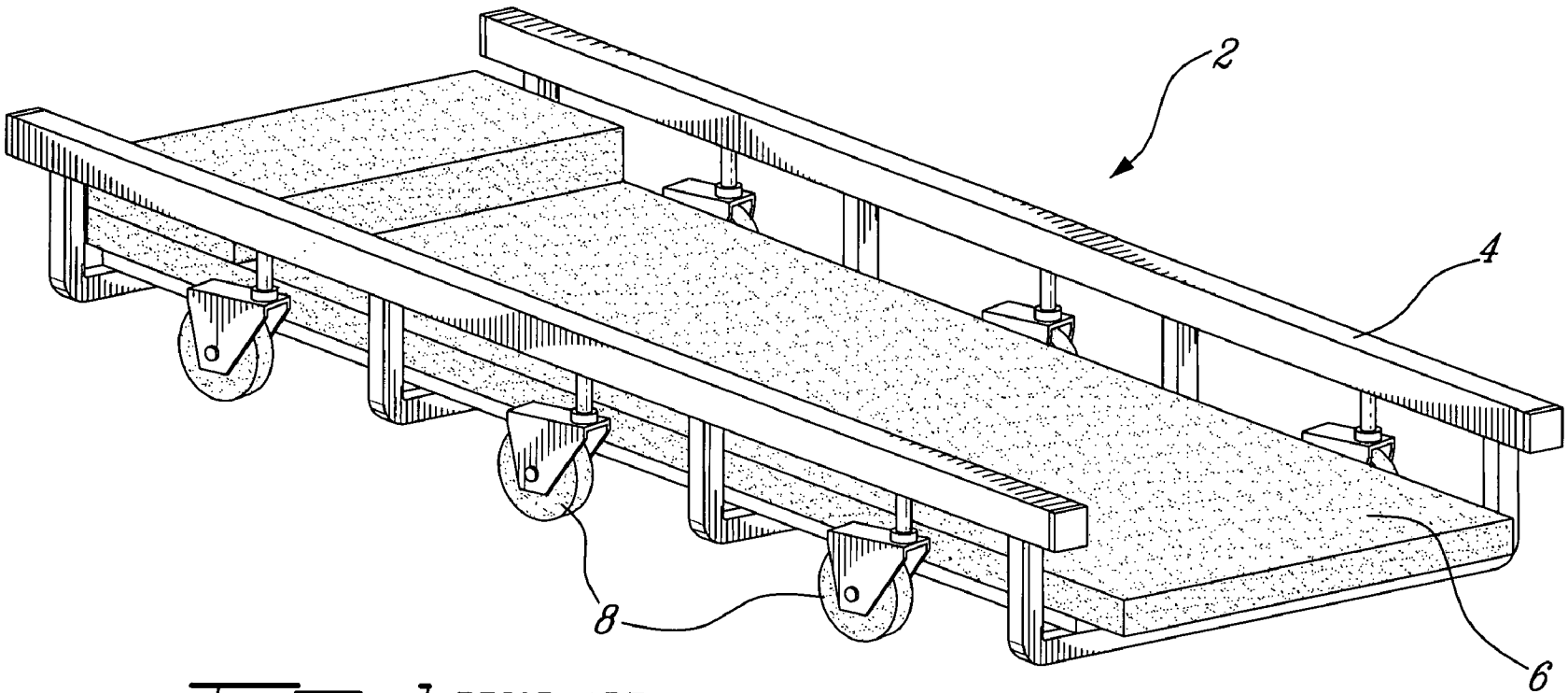
FIG. 1 PRIOR ART
FIG. 1 is a side perspective view of a known creeper.
Figure 3:
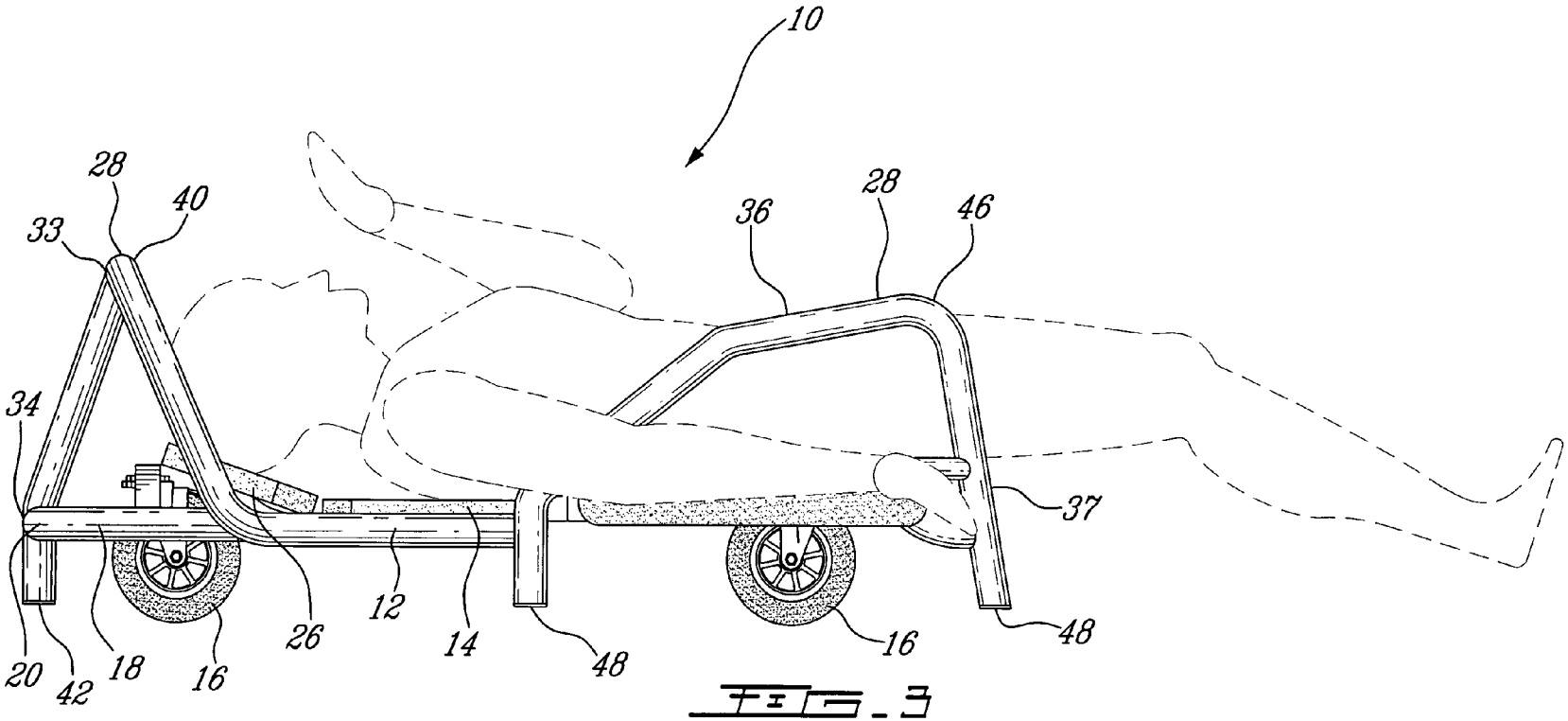
FIG. 3 is a side elevation view of the creeper of FIG. 2 illustrating an ergonomics thereof.

Referring now to FIGS. 2 and 3, the creeper 10 further comprises a safety structure 28 designed to protect the user in the event that the vehicle (not shown) under which is manoeuvring the user should fall from its elevated position. For example, the jack or jack stands (also not shown) utilised to raise the vehicle may collapse, fail or shift while the user is still underneath the vehicle. As comparatively illustrated in FIG. 1, known creepers, as in 2, do not provide such a safety structure. If a vehicle falls while a user on creeper 2 is still working underneath it, the user could be trapped and likely severely injured, if not killed, by the vehicle. The safety structure 28 of creeper 10 is thus provided, at least in part, to avoid such casualties, defining a protective space above at least a portion of the support surface 14 within which the user may be protected from the falling vehicle.

As illustrated in FIG. 3, as the user lies face-up on the user support surface 14, the upwardly projecting rigid elements of safety structure 28 illustratively extend vertically beyond the vital body parts of the user, namely the user's torso, head and abdomen. The height reached by the safety structure 28 should be properly gauged to provide a protective space adequate for an average user, and creepers of various dimensions could be provided based on the size requirements of a specific user type. Furthermore, the safety structure 28 does not impose that the vehicle under which the user operates be raised higher than needed in the absence of such a safety structure 28. Since a minimum vehicle height is required if the user is to work and manoeuvre comfortably under the vehicle, the added safety structure 28 does not pose any significant accessibility challenges.

Still referring to FIGS. 2 and 3, the safety structure 28 is illustratively comprised of a three-point safety structure defining a protective space above at least a portion of the support structure and surface 14. This illustrative safety structure 28 comprises a head protective element 33 disposed proximal to the first longitudinal end 34 of the creeper 10, and two body protective elements 36 disposed proximal to the opposite longitudinal end 37 of the creeper 10 on opposed lateral edges 39 thereof. The head protective element 33 is illustratively comprised of a three-point roll bar integrally coupled to the framework 12 via head bar 20 and lateral bars 18. The combined head protective element 33 provides a weight-bearing end 40 at its apex. A weight-bearing foot 42, extending downwardly from the head bar 20, is also provided should the weight of a fallen vehicle resting on the head protective element 33 damage the casters 16. Other types of roll bars (e.g. two-point, four-point, etc.) as well as other types and configurations of vertically projecting head protective elements 33 may also be considered without departing from the general scope and nature of the present disclosure.

The body protective elements 36 each comprise a generally inverted U shaped roll bar integrally coupled to a respective lateral bar 18 towards longitudinal end 37 of creeper 10. Each body protective element 36 provides a weight-bearing end 46 and two foot ends 48 upon which can also rest the weight of a fallen vehicle should the weight damage the casters 16. The body protective elements 36 could be designed to provide independently balanced structures by adding a third foot end (not shown) to each element 36. Also, a combination of two head protective elements could be provided instead of the three-point roll bar 33 illustrated herein, thus providing a combined four-point safety structure. Conversely, a two-point safety structure or even a single-point safety structure could be designed to tip the weight of the vehicle upon falling on the creeper, still protecting the user from being crushed within a safety space defined thereby and directly resting part of the vehicle weight on the ground. These and other such structural modifications should now be apparent to a person of skill in the art.

Furthermore, though the above safety structure 28 is described and illustrated to include respective foot ends 42 and 48 below the head and body protective elements 33 and 36, such foot ends 42, 48 may not be required to provide adequate protection to the user of creeper 10. For instance, the wheels or casters 16 may be sufficiently resilient to support the load of a fallen object, such as a vehicle, such that foot ends, as in 42 and 48, are not needed to support such a load. Alternatively, if the wheels or casters break under the fall of an object intercepted by the safety structure 28, the safety structure 28 may be adequately coupled to the framework 12 such that the load of the fallen object rests directly thereon while substantially maintaining an integrity of the protective space defined by the safety structure 28. Other such structural and functional configurations should be apparent to the person of skill in the art without departing from the general scope and nature of the present disclosure.

Still referring to FIGS. 2 and 3, the safety structure 28 is also illustratively designed to provide the user with ample work space to complete the task at hand. Namely, the body protective elements 36 are positioned at a longitudinal distance from the head protective element 33, defining a longitudinal space therebetween within which the user may have substantially unobstructed access to the vehicle. In other words, the safety structure 28 is configured to allow for arm movement between the protective elements 33 and 36. The body protective elements 36 can thus be shaped and positioned accordingly to accommodate user movement while still providing adequate protection to the user. Additionally, the head protective element 33 can also be designed accordingly. Generally, the safety structure 28, in combination with the creeper framework 12, can be designed to remain as streamlined as possible without compromising the safety of the user, thereby increasing accessibility to the vehicle underbody.

Figure 7:
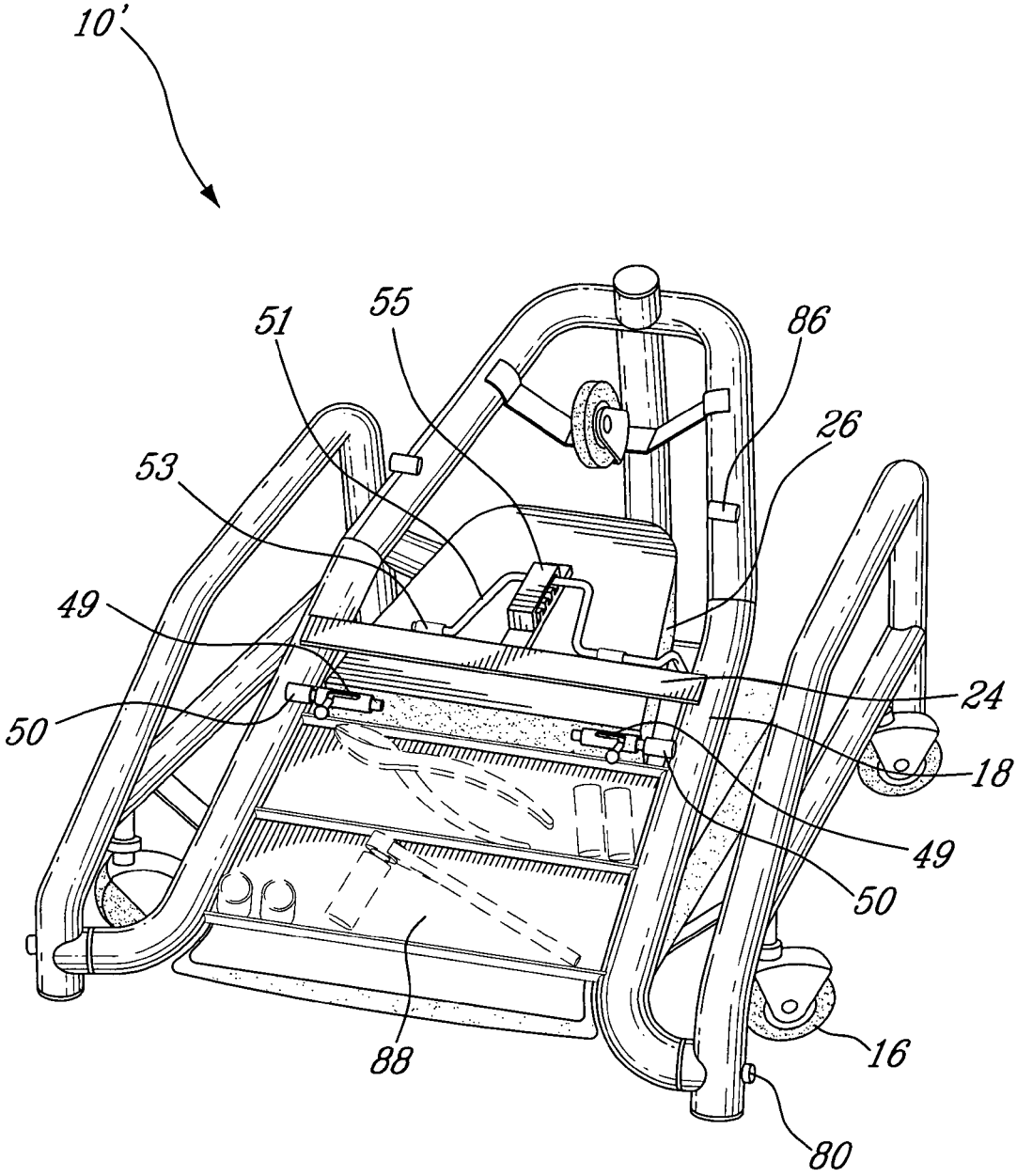
FIG. 7 is a perspective view of the creeper of FIG. 6 when partially adjusted into the folded position.

Referring now to FIGS. 2 and 7, the adjustable headrest 26 is generally adapted to provide versatility and comfort to the user. In FIG. 2, the headrest of creeper 10 is tilted up and supported via a head support mechanism best illustrated in FIG. 7, which provides a partial underside view of a similar but adjustable creeper 10' described hereinbelow in accordance with a second illustrative embodiment of the present invention. In general, the head support mechanism comprises a pivoting base support (illustrated here as slide locks 49 pivotally cooperating with corresponding locking channels 50 further described hereinbelow in the context of adjustable creeper 10') and a pivoting head support arm 51 actuated by a cooperating lever 52. Using the lever 52, the support arm 51 is selectively pivoted about its attachment point 53 to the framework 12 (illustratively on one of the transversal bars 24) and engaged with any one of a number of support slots or notches disposed in a solid anchoring member 55 correspondingly positioned on the back side of the head rest 26. As such, the user may selectively engage the support arm with a given notch of the anchoring member 55 to adjust and support the headrest 26 at a desired inclination. Note that irrespective of the headrests inclination, the head protective element 33 can be designed to project sufficiently upwards to provide adequate protection to the user's head, even when the headrest 26 is in its uppermost position.

Referring now to FIGS. 2 and 4A to 4E, the creeper 10 may be optionally fitted with a variety of stabilization and/or load-absorbing mechanisms such that when a weight W greater than a predetermined weight $W_0$ is applied to the creeper 10 through the weight-bearing ends 40 and 46 of the safety structure 28 (hereinafter referred to exclusively using the numeral 46 for simplicity), the foot ends 42 and 48 of the safety structure 28 (hereinafter referred to exclusively using the numeral 48 for simplicity) are lowered to the ground, thereby stabilizing the creeper 10 and supporting the weight W thereon.

Figure 4A:
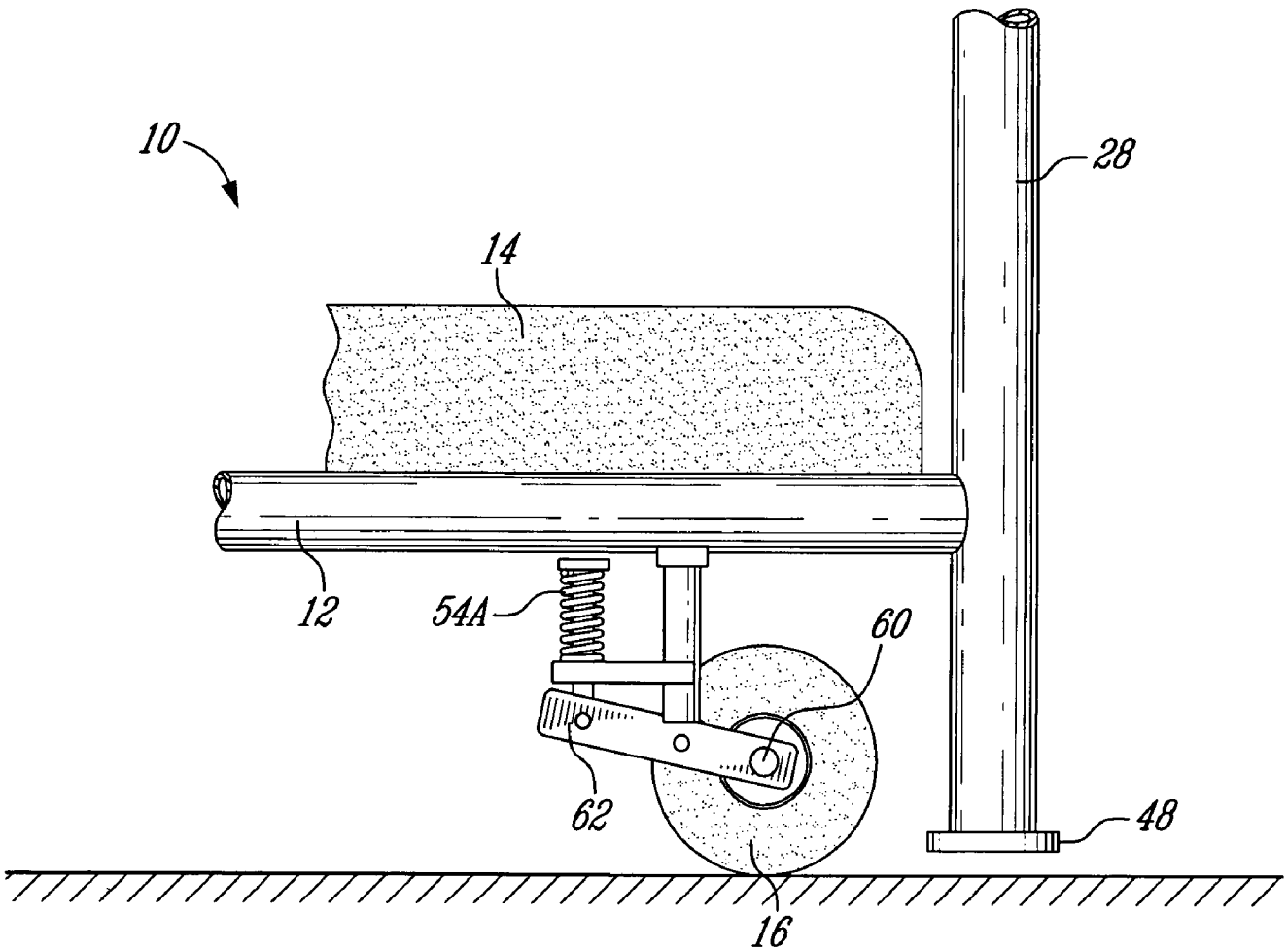
FIG. 4A is a schematic front side view of a first optional load-absorbing mechanism usable with the creeper of FIG. 2 in accordance with a first optional modification thereof.
Figure 4B:
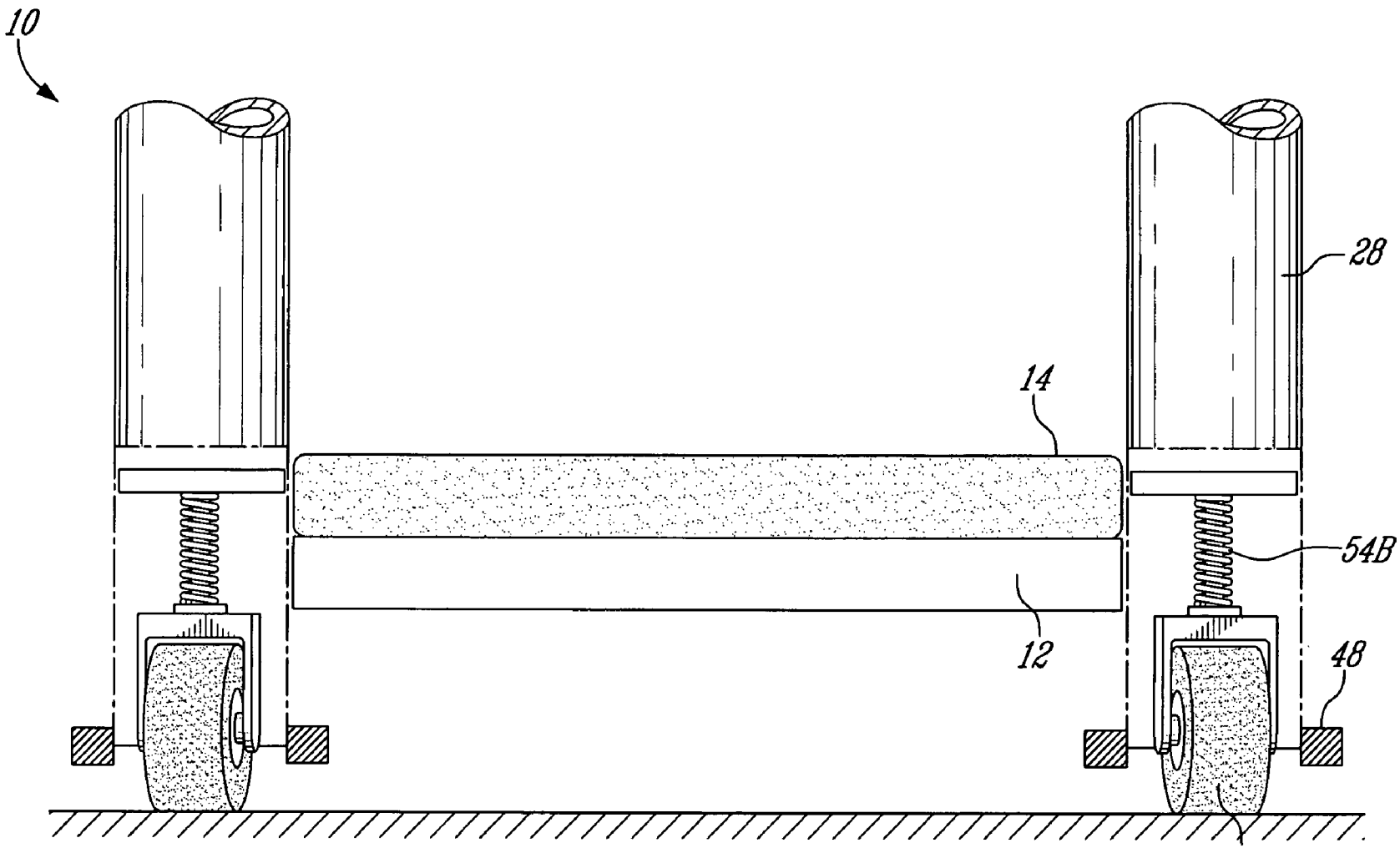
FIG. 4B is a schematic front side view of a second optional load-absorbing mechanism usable with the creeper of FIG. 2 in accordance with a second optional modification thereof.

In FIGS. 4A and 4B, a first optional modification of creeper 10 is presented wherein the stabilization mechanism described hereinabove consists of using spring-loaded casters or wheels 16. In this embodiment, when a weight W greater than a predetermined weight $W_0$ is applied to the creeper 10, the wheels or casters 16 retract underneath the creeper 10 such that the foot ends 48 of the safety structure 28 come in contact with the ground, thereby stabilizing the creeper 10 and supporting the applied weight W thereon.

In FIG. 4A, retractable wheels or casters as in 16 are coupled to the creeper 10 using a spring-activated system $\mathbf{54}_A$ that allows the casters 16 to bend upward and retract under a weight W greater than a predetermined weight $W_0$. In system $\mathbf{54}_A$, the casters or wheels 16 are mounted through their axles, as in 60, to the end of spring-activated pivoting members, as in 62, which allows the wheels 16 to retract when a weight W is applied to the creeper 10. When a weight W is applied to the creeper 10, the wheels 16 retract and the creeper 10 lowers such that the foot ends, as in 48, rest on the ground, which stabilizes the creeper 10 and allows the weight W to be supported thereon. When the weight W is removed, the creeper 10 is pushed back up by the spring-activated system $\mathbf{54}_A$, and the creeper can again be rolled around on the wheels or casters 16.

In FIG. 4B, retractable casters 16 are coupled to the creeper 10 using a spring-activated system $\mathbf{54}_B$ integrated within the foot ends 48 of the protective safety structure 28. Under an applied weight W greater than a predetermined weight $W_0$, the foot ends 48 descend over the casters 16 to rest on the ground, which stabilizes the creeper 10 and allows the weight W to be supported thereon. When the weight W is removed, the creeper 10 is pushed back up by the spring-activated system $\mathbf{54}_B$, and the creeper can again be rolled around on the casters 16.

Figure 4C:
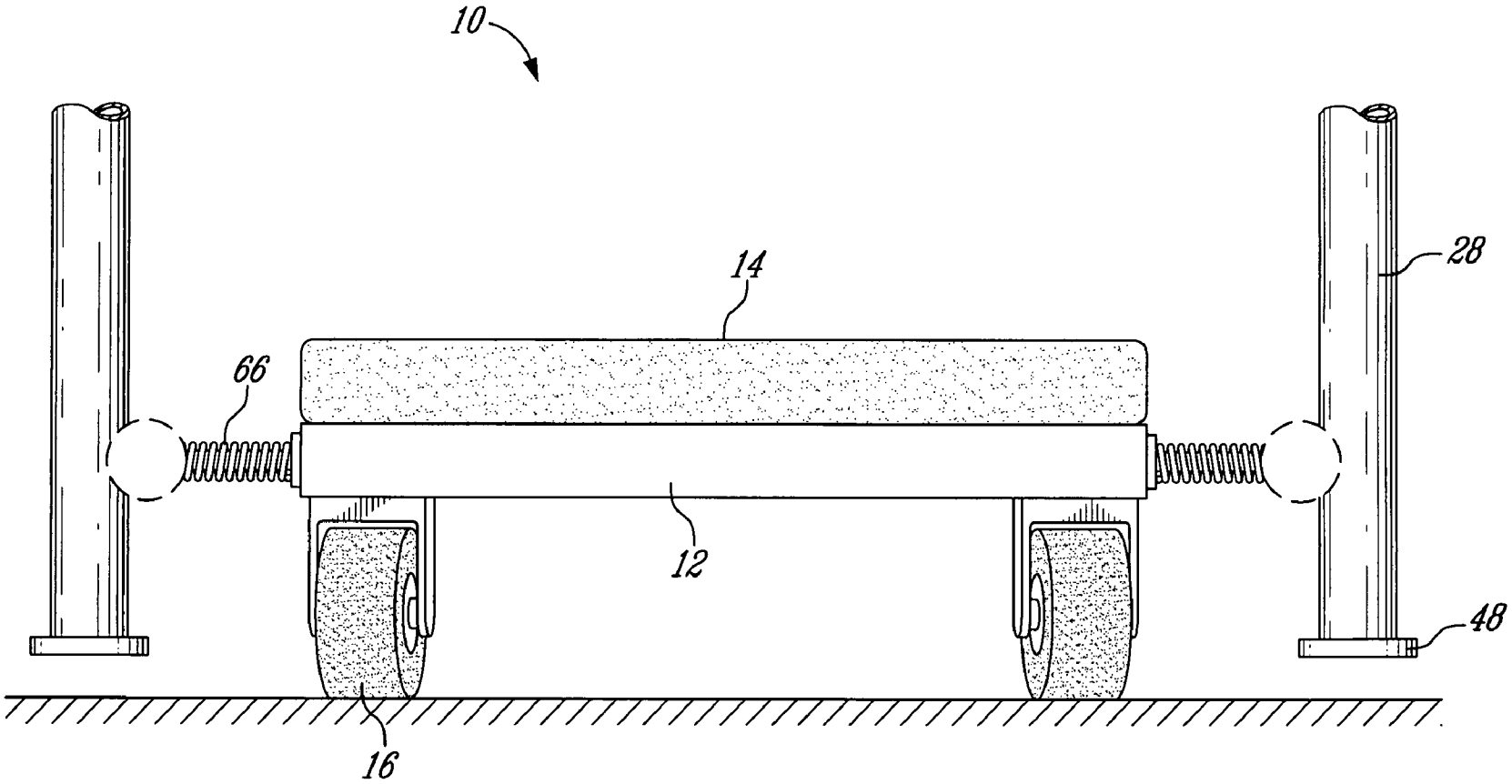
FIG. 4C is a schematic front side view of a third optional load-absorbing mechanism usable with the creeper of FIG. 2 in accordance with a third optional modification thereof.
Figure 4D:
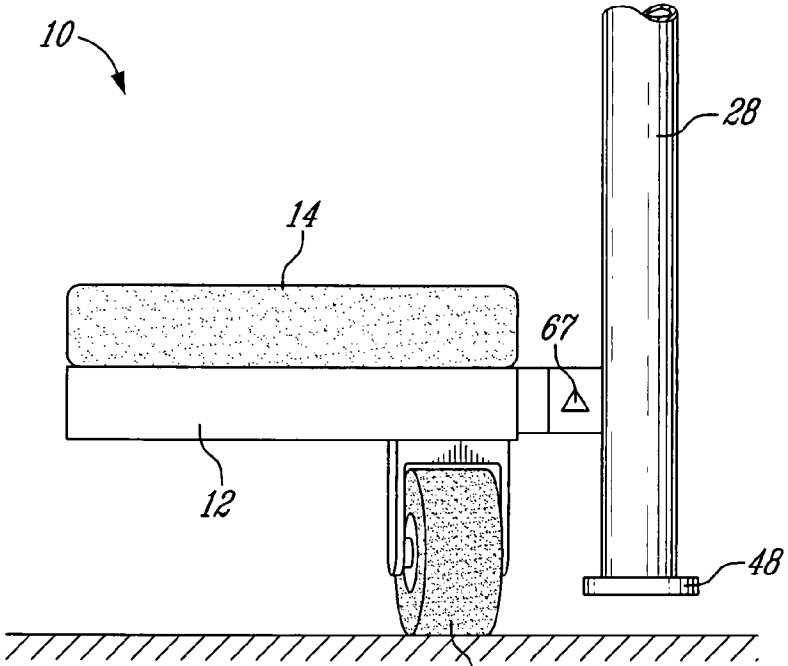
FIGS. 4D and 4E are respective schematic front side and exploded perspective views of a fourth optional load-absorbing mechanism usable with the creeper of FIG. 2 in accordance with a fourth optional modification thereof.
Figure 4E:
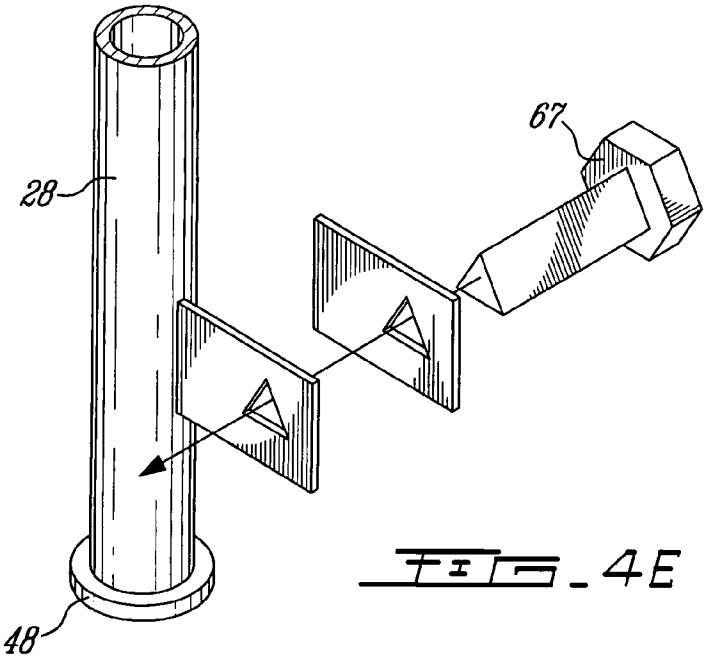

Referring now to FIGS. 4C to 4E, flexible or yieldable coupling mechanisms optionally used to attach safety structure 28 to the creeper 10 may provide alternative stabilization mechanisms that compare with those presented hereinabove with reference to FIGS. 4A and 4B. For instance, in FIG. 4C, the safety structure 28 is optionally coupled to the framework 12 of the creeper 10 using a set of flexible couplers 66, such couplers possibly including springs, flexible bands and/or jointed coupling bars to name a few. In this optional modification of the present embodiment, when a weight W greater than a predetermined weight $W_0$ is applied to the protective structure 28, the structure 28 lowers such that the foot ends 48 rest on the ground, thereby stabilizing the creeper and allowing the weight W to be supported thereon.

In FIGS. 4D and 4E, the protective structure 28 is alternatively fixedly attached to the creeper framework 12 using shear pins or bolts, as in 67. When a weight W exceeding a predetermined weight $W_0$ is applied to the protective structure 28, the shear pins 67 break and allow the foot ends 48 to rest on the ground, supporting the applied weight W thereon. The user would then be able to retract the creeper framework 12 while leaving the support structure 28 under the vehicle to support the weight W. The shear pins or bolts 67 may be triangular (as illustrated here), square, circular or of any other suitable shape and size to withstand the weight of the user while remaining yieldable to a weight W exceeding the predetermined weight $W_0$.

As will now be apparent to a person of skill in the art, other such modifications for stabilizing the creeper 10 and allowing an applied weight W to be supported by the protective structure 28 rather than the casters 16 may be considered without departing from the general scope and nature of the illustrative embodiments. For instance, retractable wheels or casters 16 may be optionally coupled to the creeper 10 using alternative spring-activated systems that allow the casters 16 to bend upward and retract under a given weight W. Such spring-activated systems may, for instance, allow spring-loaded wheel bases, laterally offset from their respective wheel axles, to angle and rotate about their respective axles under an applied weight W, which would allow the wheels or casters 16 to retract upward. The creeper 10 would thus be lowered such that the foot ends 48 rest on the ground to stabilize the creeper 10 and allow the weight W to be supported thereon. Again, when the weight W is removed, the creeper 10 would be pushed back up by the spring-activated system, and the creeper could again be rolled around on the wheels or casters 16.

Alternatively, the creeper 10 could be fitted with deformable wheels or casters that deform when a weight is applied to the creeper 10. The deformability of the wheels could be selected (either by controlling the air pressure in an inflatable tire, controlling the rigidity of a solid tire, or other such mechanisms) such that when a weight W greater than a predetermined weight $W_0$ is applied to the creeper 10, the deformable wheels are deformed sufficiently to allow the foot ends 48 to rest on the ground, which would stabilize the creeper 10 and allow the weight W to be supported thereon.

Other such systems, whether elastic, mechanical, pneumatic, hydraulic or magnetic could also be conceived to replace the above exemplary load-absorbing options without departing from the general scope and nature of the illustrative embodiments. Furthermore, even though the incorporation of such stabilization mechanisms allows one to recover and reuse the creeper 10 after an incident, no such mechanism is required if one only seeks to provide a safety feature to the user, as provided by the creeper 10 in FIG. 2. If a vehicle drops on such a creeper 10 fitted with a safety structure as in 28, but not fitted with a load-absorbing mechanism as described hereinabove, the user will still be protected from being crushed by the falling vehicle, though the impact could potentially damage the creeper framework 12 or casters 16. Whether the creeper framework 12 is bent, or again the casters 16 broken by the fall of the vehicle, the safety of the user remains a priority linked mainly to the stability and strength of the safety structure 28 and not to optional stabilization and/or load-bearing mechanisms.

Figure 5:
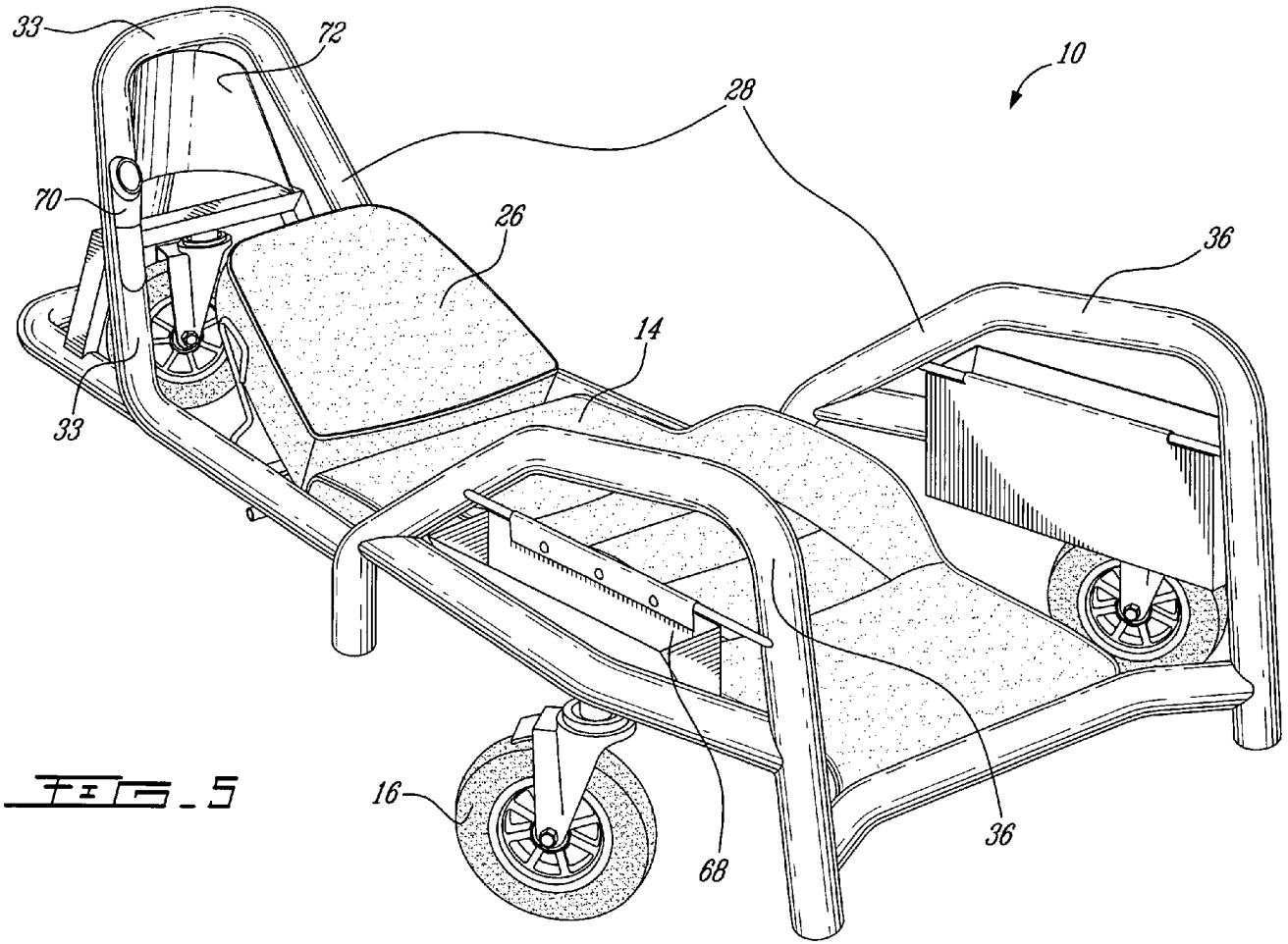
FIG. 5 is a side perspective view of the creeper of FIG. 2, optionally provided with a retractable visor, utility boxes and a work light.

Referring now to FIG. 5, the creeper 10 may also be fitted with additional optional features to increase the comfort and practicality of the creeper 10. Unlike known creepers comprised mainly of a flat structure (as seen in FIG. 2), the creeper 10, equipped with protective structure 28, provides for the installment of additional features. For example, the body protective elements 36 provide vertical attachment means for useful products, such as tool or equipment boxes 68, and other such products conveniently placed at hand's reach. On the head protective element 33, a set of adjustable lights or lamps 70 may be provided to illuminate the vehicle's underbody and improve the user's working conditions. A retractable visor or face shield 72 may also be provided to the user on the head protective element 33. The face shield 72, illustrated in FIG. 5 in its retracted position, may slide up and over the face of the user using a simple glide mechanism (not shown) coupled to the central vertical bar of element 33. Face shields as in 72 may become useful to protect the user from dripping oil or fluids from the vehicle, or again from falling particles such as dust, rust or other solid objects from above.

Additionally, referring now to FIG. 2, the body protective elements 36 also provide for easy access to the creeper 10. The user may use the elements 36 as hand rests to lower himself/herself on the creeper 10. Furthermore, with proper adjustment of an optionally selected stabilization mechanism, discussed hereinabove in conjunction with FIGS. 4A to 4C, the creeper 10 may be temporarily stabilized by the application of a localized weight on the body protective elements 36, thereby facilitating the user's access to the creeper 10.

Also, the creeper 10 of FIG. 2 may also be configured to facilitate an upright storage thereof, either against a wall or freestanding, stabilized vertically by the body protective elements 36. Such a storage option may become useful in tight work spaces, or again used as a safety measure, limiting the risk of someone tripping over the creeper 10.

Figure 6:
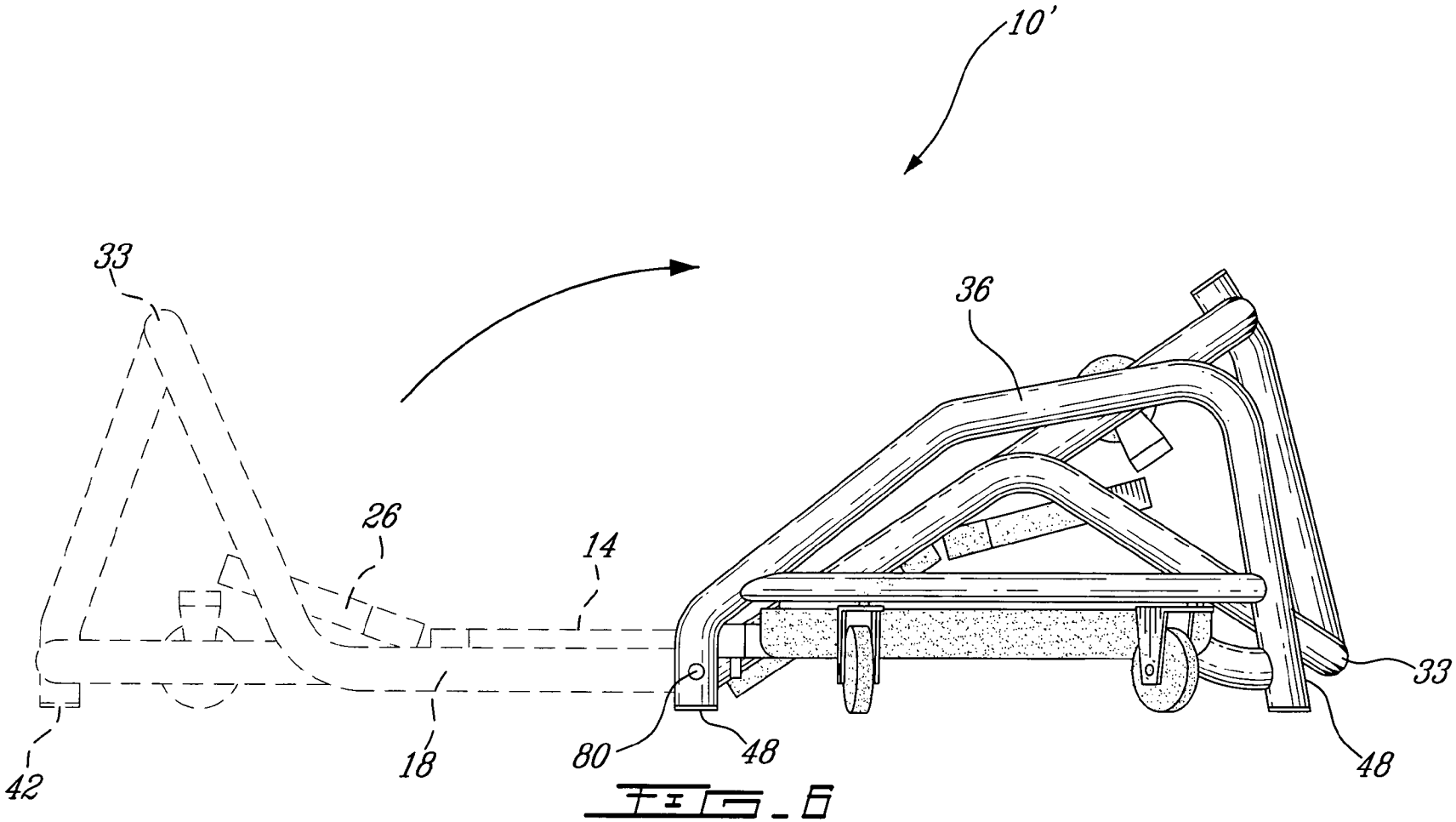
FIG. 6 is a side elevation view of a creeper adjustable between an creeper position and a work bench position in accordance with a second illustrative embodiment of the present invention; dashed lines illustrate the creeper when in the creeper position while solid lines illustrate the adjustable creeper when partially adjusted into a folded position.
Figure 8:
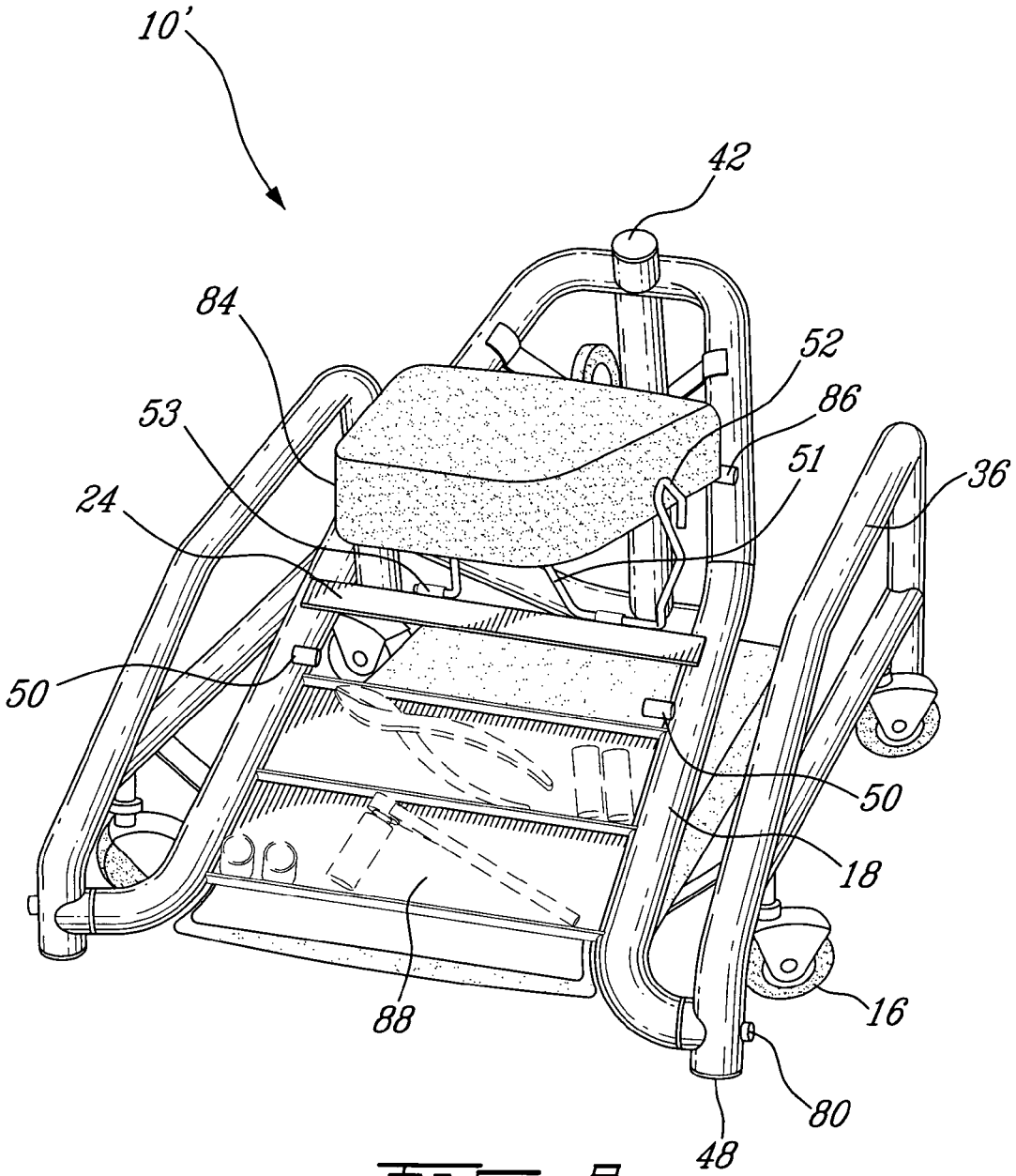
FIG. 8 is a perspective view of the creeper of FIG. 6 when fully adjusted into the work bench position.

Referring now to FIGS. 6 to 8, and in accordance with a second illustrative embodiment of the present invention, an adjustable creeper 10' will be presented. Creeper 10' is generally designed to provide the same safety and functionality features and advantages of creeper 10, as illustrated hereinabove in FIG. 2. However, creeper 10' further comprises the added feature that it may be folded and adjusted to be used as a work bench. Consequently, parts similar to creeper 10 and creeper 10' will be referred to using the same numbers for simplicity.

With particular reference to FIG. 6, the creeper 10' may be pivoted about a joint or pivot point 80 disposed intermediate the body and head protective elements 36 and 33 respectively. Once the creeper 10' is completely folded over about joint 80, as illustrated in FIG. 7, the headrest 26 of creeper 10' may be further adjusted to enable the headrest 26 to serve as a bench 84 for the user (FIG. 8), thereby allowing the user to work on a vehicle in a seated position. To provide a sturdy bench 84, the framework 12 may come to solidly rest on the body protective elements 36, or again the head protective element 33 may come to solidly rest on the foot end 44 of the creeper 10' or the ground. As such, the various protective elements 33 and 36 of structure 28 may be used to provide both a protective space for the user when used in the creeper position (dashed lines of FIG. 6) and a seat support structure when used in the work bench position (FIG. 8). Alternative support mechanisms may also be considered to support the folded creeper 10' without departing from the general scope and nature of the present disclosure.

With particular reference to FIGS. 7 and 8, the headrest 26 is illustratively maintained in its "headrest position" (FIGS. 6 and 7) by a set of slide locks 49 disposed at a base thereof. These slide locks 49 cooperate with a set of lock channels 50 projecting inwardly from the underside of the lateral bars 18. In this position, the slide locks 49 provide the pivoting base described hereinabove for inclining the headrest 26. As such, the headrest 26 may pivot about the slide locks 49 while being supported thereby in conjunction with the support arm 51.

With particular reference to FIG. 8, when the slide locks 49 are released from channels 50, the headrest 26 may be pivoted about the attachment point 53 of pivoting support arm 51 to align and lock the slide locks 49 to corresponding seat lock channels 86. In this bench position, the headrest 26 is solidly supported by the support arm 51, coupled to the framework 12 via attachment point 53, and the slide locks 49 coupled to the channels 86. The creeper 10' may be returned to its initial creeper configuration by reversing these steps.

As will be apparent to a person of skill in the art, this optional feature may be of particular use to a user that cannot remain in a bent-over position for a long period of time. Furthermore, tool boxes 88 may be disposed underneath the body support surface 14 of creeper 10' and become accessible to the user when in the work bench configuration (as seen in FIG. 8). Furthermore, by optionally modifying the creeper 10' to include a properly adjusted stabilization and/or load-bearing mechanism, as described hereinabove with reference to FIGS. 4A to 4C, the weight of the user in a seated position may suffice to lower the foot ends 48 of elements 36 to the ground, thereby stabilizing the creeper 10'. As will now be apparent to a person of skill in the art, any folding mechanism may be implemented on any given segment of the creeper 10' to obtain a similar result.

As will now be apparent to the person of skill in the art, the safety structure 28 described hereinabove provides a safety feature to a user working under an elevated vehicle. Namely, if the vehicle were to drop on the user while the user is working under the vehicle, the safety structure 28 would protect the user by intercepting the fall of the vehicle, the user remaining substantially unharmed within the protective space defined thereby. Furthermore, by incorporating a stabilization and/or load-absorbing mechanism as discussed hereinabove with reference to FIGS. 4A to 4E, the falling vehicle may activate this mechanism, which would subsequently apply the foot ends 48 of the safety structure 28 to the ground, thereby stabilizing the creeper 10 (or 10') and supporting the vehicle's weight thereon. This optional mechanism could reduce the likelihood of damage being imparted to the creeper 10 after an incident. The incorporation of such mechanisms are not required to provide a full safety feature to the user on a creeper fitted with a safety structure as discussed herein.

While this invention has been described with reference to the illustrative embodiments, this description is not intended to be construed to a limiting sense. Various modifications or combinations of the illustrative embodiments, as well as other embodiments of the invention, will be apparent to persons skilled in the art upon reference to the description. It is therefore intended that the described invention encompass any such modifications or embodiments.

What is claimed is:

1. A creeper for protecting a user in a supine position when maneuvering under a motor vehicle raised on a support, the motor vehicle capable of causing injury to the user when the support is removed, the creeper comprising:

a support structure comprising a frame and a user support surface; and a safety structure coupled to said frame;

said safety structure comprising at least three upwardly projecting rigid elements defining a protective space above at least a portion of said support surface in which the user in the supine position is protected, since the safety structure is capable of supporting the a weight of the motor vehicle when the support is removed; wherein the at least three upwardly projecting rigid elements comprises at least one head protective element disposed directly adjacent a first longitudinal end of said support structure, said at least one head protective element defining a head protective space above said first longitudinal end; wherein said at least three upwardly projecting rigid elements further comprises at least two body protective elements disposed directly adjacent a second longitudinal end of said support structure and cooperating with said at least one head protective element to define said protective space.

2. The creeper of claim 1, the creeper further comprising a set of casters coupled to said support structure for facilitating a displacement of the creeper under the raised object.

3. The creeper of claim 1, wherein said at least one rigid element is adapted to intercept the object when falling toward the creeper while substantially maintaining an integrity of said protective space.

4. The creeper of claim 3, the creeper further comprising displacement means and load-absorbing means, said displacement means being structurally coupled to said safety structure via said load-absorbing means, said load-absorbing means being adapted to retract said displacement means relative to said support structure when said at least one rigid element is subjected to the weight of the object.

5. The creeper of claim 1, said support surface comprising an inclinable headrest disposed towards said first longitudinal end, said at least one head protective element projecting sufficiently upwards to define said head protective space above said headrest when said headrest is inclined.

6. The creeper of claim 1, wherein said at least one head protective element comprises a roll bar disposed above said first longitudinal end.

7. The creeper of claim 6, wherein said roll bar comprises an at least three-point roll bar.

8. The creeper of claim 1, wherein said at least two body protective elements are disposed on opposed lateral edges of said support structure.

9. The creeper of claim 1, wherein said at least two body protective elements and said at least one head protective element are longitudinally spaced apart and define a longitudinal space therebetween, thereby providing the user substantially unobstructed access to the object from said surface within said longitudinal space.

10. The creeper of claim 1, the creeper further for providing an elevated sitting surface, said support structure comprising a body support portion, a head support portion and, a pivot intermediate said head support portion and said body support portion, the creeper being foldable about said pivot into a folded position solidly resting said head support portion above said body support portion such that, when in said folded position, said head support portion provides the elevated sitting surface.

11. The creeper of claim 10, said head support portion comprising a head support frame and a headrest, said headrest being adjustable relative to said head support frame to provide the elevated sitting surface.

12. A creeper for protecting a user in a supine position when maneuvering under a motor vehicle raised on a support, the motor vehicle capable of injuring the user when the support is removed, the creeper comprising:

a user support surface; and a safety structure;

said safety structure comprising at least one upwardly projecting head protective element disposed directly adjacent a first longitudinal end of said surface and at least two upwardly projecting body protective element disposed directly adjacent a second longitudinal end and on either side of said surface, said protective elements together defining a three point protective structure defining a protective space above at least a portion of said surface in which the user in the supine position is protected since the safety structure is capable of supporting a weight of the motor vehicle when the support is removed and;

wherein said at least one head protective element and said at least two body protective elements are longitudinally spaced apart and define a longitudinal space therebetween, thereby providing the user substantially unobstructed access to the object from said surface within said longitudinal space.

13. The creeper of claim 12, wherein said at least one head protective element comprises a roll bar.

14. The creeper of claim 13, wherein said roll bar comprises an at least three-point roll bar.

15. The creeper of claim 13, wherein said at least one head protective element and said at least two body protective elements are adapted to cooperatively intercept the object when falling toward the creeper while substantially maintaining an integrity of said protective space.

16. The creeper of claim 12, wherein the at least two body protective elements respectively disposed towards opposed lateral edges of said surface, thereby defining a lateral space therebetween and providing substantially unobstructed user body access to said surface from above said surface.

17. The creeper of claim 16, wherein each of said body protective elements comprise a roll bar respectively disposed along said opposed lateral edges.

* * * * *